United States Patent [19]

Chiang et al.

[11] Patent Number: 5,033,715

[45] Date of Patent: Jul. 23, 1991

[54] INFRARED FAUCET

[76] Inventors: Sing Chiang, 4 Fl., No. 19, Lane 60, Chung Hua Rd., Hsin Tien City, Taipei Hsien; Chin H. Hsieh, No. 1, Lane 103, Yung Tai St., Chung Li City, Tao Yuan Hsien, both of Taiwan

[21] Appl. No.: 574,745

[22] Filed: Aug. 30, 1990

[51] Int. Cl.[5] ..... F16K 31/04

[52] U.S. Cl. ..... 251/129.04; 251/129.12; 251/129.11; 4/623

[58] Field of Search ..... 251/129.04, 129.12; 4/623

[56] References Cited

U.S. PATENT DOCUMENTS 4,957,274 9/1990 Hood et al. ..... 251/129.12

*Primary Examiner*—Arnold Rosenthal

*Attorney, Agent, or Firm*—Morton J. Rosenberg; David I. Klein

[57] ABSTRACT

A faucet includes a sensing/driving assembly having a transmitting/sensing unit electrically connected with a driving device. A driving shaft of the driving device is connected with an actuating device. The actuating device has an actuating stud which depresses a plate having a valve member to control the opening and closing of the faucet.

5 Claims, 2 Drawing Sheets

INFRARED FAUCET

BACKGROUND OF THE INVENTION

The present invention relates to an improved faucet, and more particularly, to an faucet which outputs water under the control of an infrared ray.

A conventional faucet employs one or two control valves to regulate and turn on the water. During use, the user turns on the water to wet his hands, lathers them with soap, rinses them, and then shut off the water. This method has the disadvantage that the water is running continuously while the user is lathering his hands or face, which in view of society's stand on water conservation, is wasteful. Another disadvantage is that when the user is going to shut off the water, his hands still wet; consequently the faucet's valves and the area surrounding the faucet gets wet. This situation creates unsanitary conditions. And if the user is going to conserve water by shutting off the valves while lathering, he still leaves soap and water on the faucet and surrounding area.

The present invention provides an improved faucet to mitigate and/or obviate the above-mentioned problem encountered during use of conventional faucets.

SUMMARY OF THE INVENTION

The faucet according to the present invention comprises an upper casing and a lower casing which together define a chamber therein. An inlet pipe which communicates with a water source is attached to a lower end of the lower casing. The upper casing is connected with an outlet pipe through which water is outputted.

A valve seat is provided in the chamber above the lower casing, and separates the chamber into an inlet chamber and an outlet chamber. The valve seat has an opening through which the inlet chamber and the outlet chamber communicate with each other. A plate is pivotally mounted inside the inlet chamber. A valve member is mounted on the plate right below the opening and is supported by a valve spring on a bottom surface of the inner chamber.

An actuating means is rotatably mounted in the lower casing with a first end thereof located in the inner chamber and a second end thereof located outside the lower casing. An actuating stud eccentrically protrudes from the first end of the actuating means and rests on the plate.

A sensing/driving assembly is attached to the second end of the actuating means. The sensing/driving assembly comprises a transmitting/sensing unit electrically connected with a driving means. A driving shaft of the driving means is connected with the second end of the actuating means and drives the actuating means. A mount plate is rotatably mounted on the driving shaft, and two magnets are diametrically mounted on the mount plate. A magnetic switch is disposed adjacent to an outer periphery of the mount plate to face one of the two magnets and is electrically connected to the driving means. The transmitting/sensing unit is activatable to actuate the driving means, wherein the driving means is turned off by the magnetic switch when the magnetic switch faces another magnet through 180 degree rotation of the driving shaft.

The opening is blocked by the valve member when the actuating stud is in an uppermost position. The opening is opened when the actuating stud is rotated to a lowest position, while the plate with the valve member thereon is depressed.

It is therefore an object of the present invention to provide a hands-free faucet.

Another object of the present invention is to provide a faucet in which a plate with a valve member actuated by a actuating means is utilized to control the opening and closing of the faucet.

It is still another object of the present invention to provide a faucet in which a transmitting/sensing unit and a magnetic switch are utilized to control a driving means which drives the actuating means.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
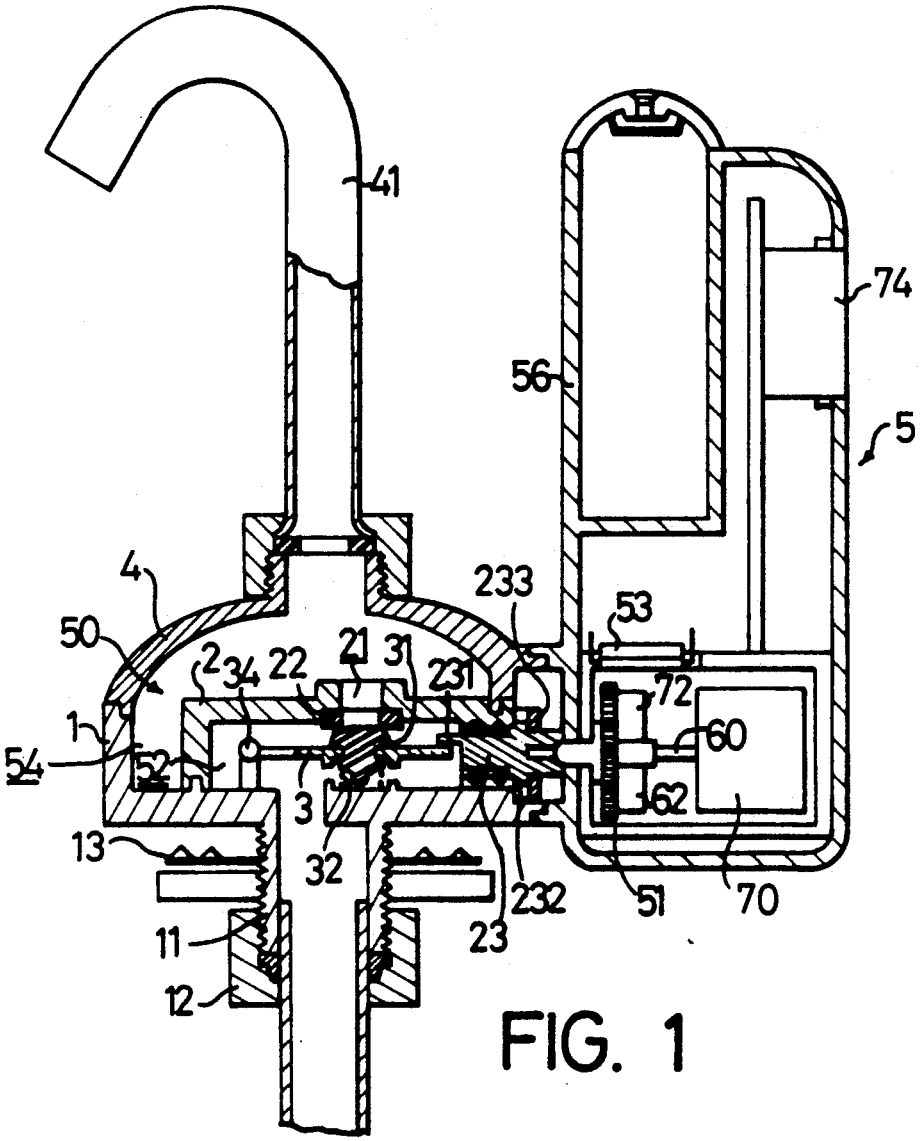
FIG. 1 is a cross-sectional view of an improved faucet in accordance with the present invention.
Figure 3:
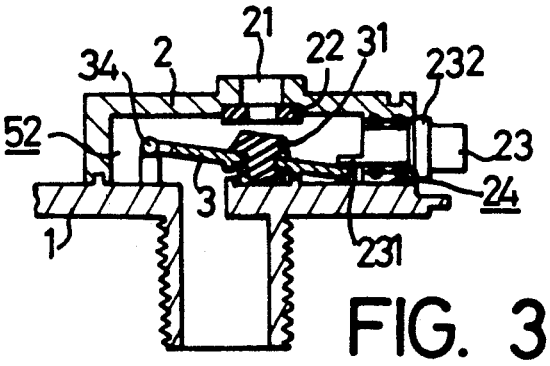
FIG. 3 is a cross-sectional view showing the operation of a controlling plate and a valve member.
Figure 2:
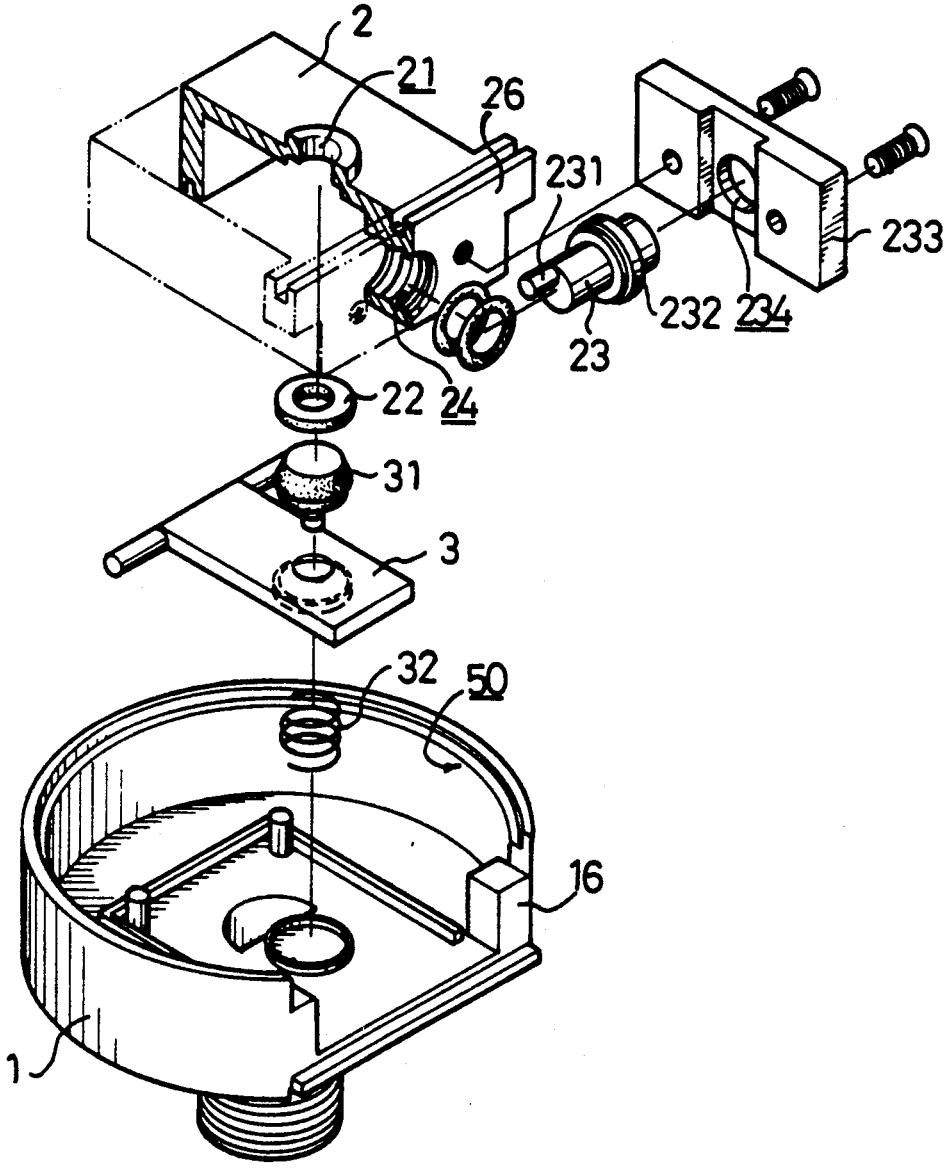
FIG. 2 is an exploded perspective view of an improved faucet according to the present invention, where in an upper casing of the faucet is removed.

Referring to FIGS. 1 through 3, the faucet according to the present invention comprises an upper casing 4 and a lower casing 1 which together define a chamber 50 therein. The lower casing 1 has an inlet pipe 11 attached to a lower end thereof. The inlet pipe 11 communicates with a water source (not shown) and is fixed by a nut 12 and a serrated lock washer 13. The upper casing 4 is attached to a spigot 41 which outputs water.

Located in the chamber 50, above the lower casing 1, is a valve seat 2 which separates the chamber 50 into an inlet chamber 52 and an outlet chamber 54. The valve seat 2 has an opening 21 through which the inlet chamber 52 communicates with the outlet chamber 54. A water-seal washer 22 is provided below the opening 21. A plate 3 is pivotally mounted inside the inlet chamber 52. A valve member 31, supported by a valve spring 32 on a bottom surface of the inner chamber 52, is mounted on the plate 3 directly below the opening 21. The plate 3, together with the valve member 31, is pivotable about a joint point 34 to control the opening and closing of the opening 21.

As shown in FIG. 2, the valve seat 2 is substantially a box with an open bottom side. The box has an engage/seal portion 26 to engage with an associated portion 16 of the lower casing 1 to seal the lower portion of the faucet, while the upper portion of the faucet is sealed by the upper casing 4. Incidentally, the valve seat 2 may alternatively be integrally formed with the lower casing 1.

Still referring to FIG. 2, there is a first hole 24 formed in the engage/seal portion 26. A thrust plate 233 with a second hole 234 is secured to the engage/seal portion 26 by conventional means, such as screws. An actuating means 23 is rotatably mounted in the first hole 24 and the second hole 234. A actuating stud 231 eccentrically protrudes from a first end of the actuating means 23 above the plate 3. Referring to FIG. 1, when the actuating stud 231 is in an uppermost position and the plate 3 is not depressed and the faucet is in a closed status. When the actuating stud 231 rotates to its lowest position, upon rotation of the actuating means 23, the plate 3 is depressed to bias the valve spring 32, while at the same time, the opening 21 is no longer blocked by the valve member 31, as shown in FIG. 3. Subsequently, water outputs through the opening 21 and the spigot 41.

A sensing/driving assembly 5 is attached to the actuating means 23. The sensing/driving assembly 5 comprises an infrared transmitting/sensing unit 74, which serves as an infrared transmitter and receiver, and is electrically connected with a driving means 70. The sensing/driving assembly 5 further has a driving shaft 60 which is connected with and drives the actuating means 23. A mount plate 51 is rotatably mounted on the driving shaft 60, and two magnets 72, 62 are diametrically mounted on the mount plate 51. A magnetic switch 53 is disposed adjacent to the outer periphery of the mount plate 51 to face one of the magnets 72 or 62, and is electrically connected to the driving means 70. All the elements of the sensing/driving assembly 5 are enclosed in a casing 56, as shown in FIG. 1.

In use, the user raises his hand to interrupt the infrared ray transmitted by the transmitting/sensing unit 74 such that the reflected infrared ray is received by the transmitting/sensing unti 74 to initiate the driving means 70. Accordingly, the actuating means 23 is actuated by the driving shaft 60. The actuating stud 231 rotates to depress the plate 3 and the valve member 31, while the valve spring 32 is biased by the plate 3. Consequently, the faucet is opened and water outputs. Nevertheless, when the driving shaft 60 rotates through 180 degrees, the magnetic switch 53 faces the other magnet 62 and is thus actuated to turn the driving means 70 off. Accordingly, when the actuating stud 231 remains at its lowest position, the faucet remains in an opened status.

When the infrared ray transmitted by the transmitting/sensing unit 74 is interrupted again, the driving means 70 is actuated to rotate the actuating means 23. The actuating stud 231 rotates toward to its original uppermost position and the faucet is gradually closed because the valve spring 32 pushes the valve member 1 and the plate 3 upwardly to block the opening 21. Again, when the driving shaft 60 rotates through 180 degrees, the magnetic switch 53 faces the magnet 72 again and is thus actuated to turn the driving means 70 off. Accordingly, when the actuating stud 231 remains in its uppermost position, the faucet remains closed.

Alternatively, the infrared transmitting/sensing unit 74 can be replaced by other devices or means, such as a voice control unit or a radio control unit, etc.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A faucet comprising an upper casing and a lower casing which together define a chamber therein, an inlet pipe, which communicates with a water source, being attached to a lower end of said lower casing, said upper casing being connected with an outlet pipe through which water is outputted, the improvements comprising:

a valve seat being provided in said chamber above said lower casing and separating said chamber into an inlet chamber and an outlet chamber, said valve seat having an opening through which said inlet chamber communicates with said outlet chamber, a plate being pivotally mounted inside said inlet chamber, a valve member being mounted on said plate directly below said opening and being supported by a valve spring on a bottom surface of said inner chamber;

an actuating means being rotatably mounted in said lower casing with a first end thereof located in said inner chamber and a second end thereof located outside said lower casing, an actuating stud eccentrically protruding from said first end of said actuating means above said plate;

a sensing/driving assembly being attached to said second end of said actuating means, said sensing/driving assembly comprising a trasmitting/sensing unit electrically connected with a driving means, a driving shaft of said driving means being connected with said second end of said actuating means and driving said actuating means, a mount plate being rotatably mounted on said driving shaft and two magnets being diametrically mounted on said mount plate, a magnetic switch being disposed adjacent to an outer periphery of said mount plate to face one of said two magnets and being electrically connected to said driving means, said transmitting/sensing unit being activatable to actuate said driving means, wherein said driving means is turned off by said magnetic switch when said magnetic switch faces the other magnet through 180 degree rotation of said driving shaft;

said opening being blocked by said valve member when said actuating stud is in an uppermost position, said opening is opened when said actuating stud is rotated to a lowest position while depressing said plate together with said valve member.

2. A faucet as claimed in claim 1, wherein said transmitting/sensing unit is an infrared transmitting/sensing unit.

3. A faucet as claimed in claim 1, wherein said transmitting/sensing unit is a radio controllable unit.

4. A faucet as claimed in claim 1, wherein said transmitting/sensing unit is a voice controllable unit.

5. A faucet as claimed in claim 1, further comprising a thrust plate to securely fix said actuating means on said lower casing.

* * * * *